US005864231A

United States Patent [19]

Alexis

[11] Patent Number: 5,864,231

[45] Date of Patent: Jan. 26, 1999

[54] SELF-COMPENSATING GEOMETRY-ADJUSTED CURRENT MIRRORING CIRCUITRY

[75] Inventor: Ranjeet Alexis, Folsom, Calif.

[73] Assignee: Intel Corporation, Santa Clara, Calif.

[21] Appl. No.: 940,693

[22] Filed: Sep. 30, 1997

Related U.S. Application Data

[63] Continuation of Ser. No. 780,603, Jan. 8, 1997, abandoned, which is a continuation of Ser. No. 458,735, Jun. 2, 1995, abandoned.

[51] Int. Cl.[6] ..... G05F 3/16

[52] U.S. Cl. ..... 323/315

[58] Field of Search ..... 323/312, 315, 323/316, 317; 330/257, 288

[56] References Cited

U.S. PATENT DOCUMENTS

| | | | |
|---|---|---|---|
| 4,300,091 | 11/1981 | Schade, Jr. . | |
| 4,629,973 | 12/1986 | Voorman . | |
| 4,748,320 | 5/1988 | Yorimoto et al. | 235/492 |
| 4,779,061 | 10/1988 | Matthies | 330/288 |
| 5,134,310 | 7/1992 | Mobley et al. | 307/270 |
| 5,179,356 | 1/1993 | Kroner | 323/315 |
| 5,367,210 | 11/1994 | Lipp | 326/26 |
| 5,512,815 | 4/1996 | Schrader | 323/315 |
| 5,617,056 | 4/1997 | Main et al. | 327/538 |

*Primary Examiner*—Matthew Nguyen
*Attorney, Agent, or Firm*—Blakely, Sokoloff, Taylor & Zafman LLP

[57] ABSTRACT

A self-compensating current mirroring circuit including first and second transistor devices respectively joined in the path of a current to be mirrored and the path of a mirrored current, the first transistor device being in circuit with a compensating transistor device, the sizes of the first and second transistor devices being such that the currents through the first and second transistor devices are maintained at identical levels during operation.

18 Claims, 3 Drawing Sheets

SELF-COMPENSATING GEOMETRY-ADJUSTED CURRENT MIRRORING CIRCUITRY

This is a continuation of application Ser. No. 08/780,603 filed Jan. 8, 1997, now abandoned which is a continuation of application Ser. No. 08/458,735 filed on Jun. 2, 1995, now abandoned.

BACKGROUND OF THE INVENTION

1. Field of the Invention

This invention relates to circuitry for controlling the value of currents and, more particularly, to methods and apparatus for providing improved current mirroring circuitry.

2. History of the Prior Art

In electronic circuitry, it is often desirable to provide a current which has a value identical to that of a current through some other circuit device not in series with the first device. This is typically accomplished through the use of a current mirroring circuit. By maintaining the voltage levels equal at gate and source terminals of a pair of field effect transistor (FET) devices operating in saturation, the current through the devices may be kept equal. However, there are situations in which circuit conditions tend to vary during use; and it is necessary to maintain the current equality in the face of these variations. To accomplish this, a negative feedback scheme has been used as a part of the current mirror circuitry to adjust the currents in response to current variations caused by noise, changes in ambient temperatures, or the like.

A problem with such a feedback scheme is that it produces an inherent mismatch in the drain voltages of the mirroring transistors and a degradation of the accuracy of the mirror. Sometimes more accuracy of current equality is necessary than is provided by the standard negative feedback arrangement.

It is desirable to provide circuitry which will produce a more accurate self-compensating arrangement for current mirroring.

Another problem encountered with current mirroring arrangements which use negative feedback for compensation is that such systems must be designed to operate with a particular supply voltages. For example, some portable computers are designed to perform with either five volt or 3.5 volt power supplies. To function with one system or the other, the current mirroring arrangements must be designed for the particular range. It is possible for a current mirroring arrangement which uses negative feedback to perform well in one range but improperly outside that designed range. Often circuit boards must be designed so that they may be used with more than one range of supply voltages. This has eliminated the ability to use self-compensating current mirroring arrangements.

It is desirable for a current mirror circuit to be able to mirror currents very accurately within its designed range of operation yet continue to mirror current with acceptable accuracy outside the designed range of operation.

SUMMARY OF THE INVENTION

It is, therefore, an object of the present invention to provide apparatus and a method for mirroring current very accurately within a designed operational range of voltages.

It is another object of the present invention to provide apparatus and a method for mirroring current very accurately within a designed operational range of voltages and within acceptable accuracy outside the designed range of operation.

These and other objects of the present invention are realized using apparatus which includes a first current mirroring circuit which is used to provide a precise mirroring of currents using a unique negative feedback circuit. In contrast to all prior art current mirrors, the current mirroring arrangement uses field effect transistor devices with unequal dimensions which allow the inequalities produced by self-compensation to be eliminated. The first current mirroring circuit may also be used with a second current mirroring circuit and means for enabling one or the other of the circuits depending on the voltage range in which the circuits are operating. The first current mirroring circuit may be used in a higher of two possible voltage ranges. The second current mirroring circuit is more standard in form and is switched into operation in place of the first circuit to provide a mirroring of currents when the supply voltage falls into a lower of the two possible voltage ranges. The combined circuit provides mirroring of currents across a number of possible ranges of the system while providing very precise self-compensating current mirroring in the higher voltage range.

These and other objects and features of the invention will be better understood by reference to the detailed description which follows taken together with the drawings in which like elements are referred to by like designations throughout the several views.

NOTATION AND NOMENCLATURE

Some portions of the detailed descriptions which follow are presented in terms of symbolic representations of operations on data bits within a computer memory. These descriptions and representations are the means used by those skilled in the data processing arts to most effectively convey the substance of their work to others skilled in the art. The operations are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like. It should be borne in mind, however, that all of these and similar terms are to be associated with the appropriate physical quantities and are merely convenient labels applied to these quantities.

Further, the manipulations performed are often referred to in terms, such as adding or comparing, which are commonly associated with mental operations performed by a human operator. No such capability of a human operator is necessary or desirable in most cases in any of the operations described herein which form part of the present invention; the operations are machine operations. Useful machines for performing the operations of the present invention include general purpose digital computers or other similar devices. In all cases the distinction between the method operations in operating a computer and the method of computation itself should be borne in mind. The present invention relates to a method and apparatus for operating a computer in processing electrical or other (e.g. mechanical, chemical) physical signals to generate other desired physical signals.

DETAILED DESCRIPTION

Figure 1:
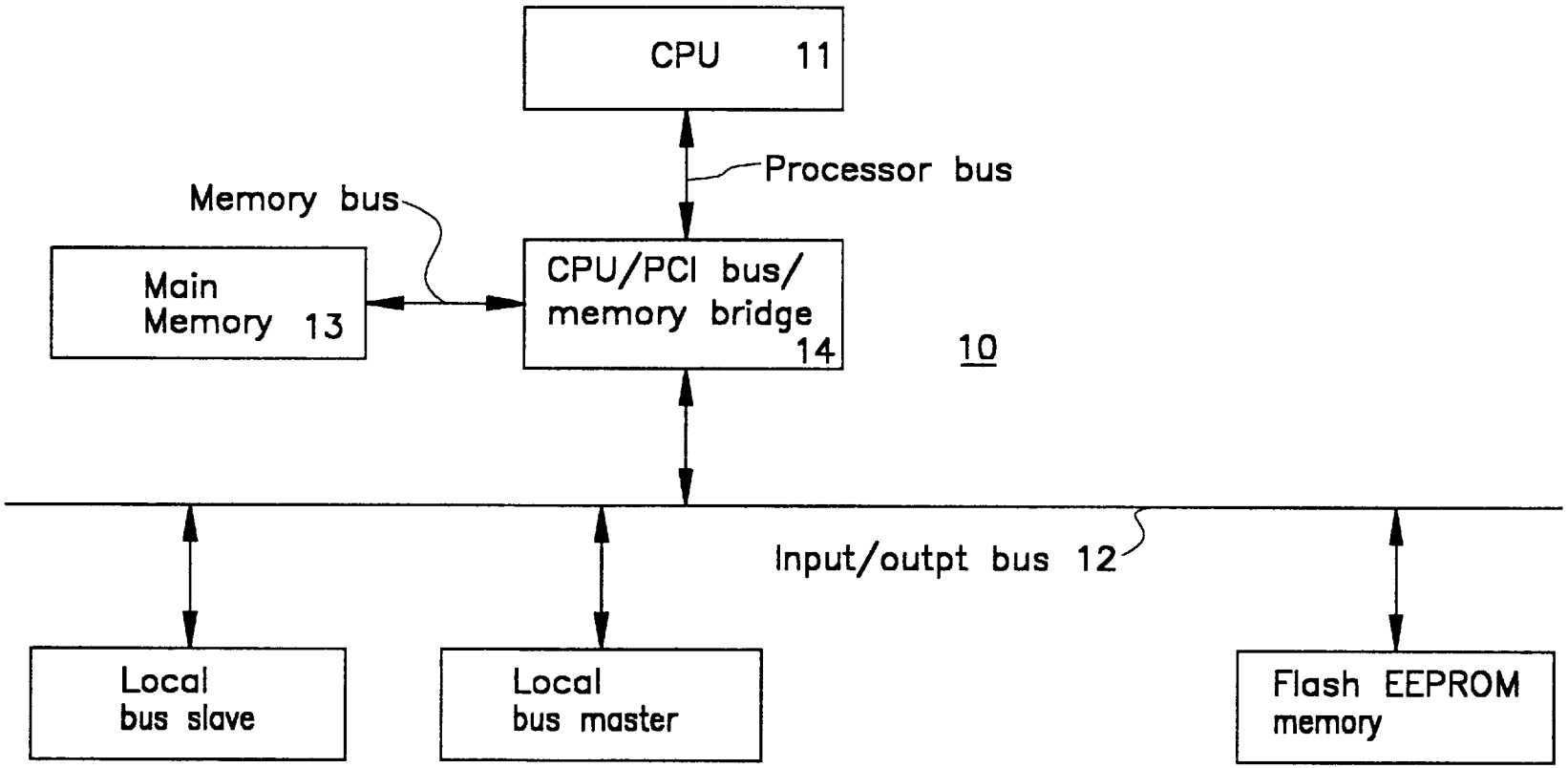
FIG. 1 is a block diagram of a computer system which may utilize the present invention.

Referring now to FIG. 1, there is illustrated a block diagram of a digital system 10 configured in accordance with one embodiment of the present invention. The present invention has application in any system, including a computer system, utilizing circuitry in which a current is to be very precisely mirrored. The system 10 illustrated includes a central processing unit 11 which executes the various instructions provided to control the operations of the system 10. The central processing unit 11 is typically joined by a processor bus to a bridge circuit 14 which controls access to an input/output bus 12 adapted to carry information between the various components of the system 10. The bridge 14 is also typically joined by a memory bus to main memory 13 which is typically constructed of dynamic random access memory arranged in a manner well known to those skilled in the prior art to store information during a period in which power is provided to the system 10. In FIG. 1, the bus 12 is preferably a peripheral component interface (PCI) bus or other local bus adapted to provide especially fast transfers of data. In a typical system 10, various input/output devices are connected as bus master and bus slave circuits to the bus 12.

In addition to the usual input/output devices typically joined to a system bus 12, additional memory may be provided for the system by a flash EEPROM memory array which may be positioned on the bus. A flash EEPROM memory array is one instance in which the present invention finds use in a computer system. A flash EEPROM memory array is constructed of a large plurality of floating-gate metal-oxide-silicon field effect transistor devices arranged as memory cells in typical row and column fashion with circuitry for accessing individual cells and placing the memory transistors of those cells in different memory conditions. Such memory transistors may be programmed by storing a charge on the floating gate. This charge remains when power is removed from the array. The charge level may be detected by interrogating the devices.

In order to detect the value of the charges stored in one type of flash memory manufactured by Intel Corporation of Santa Clara, Calif., reference cells are provided which utilize additional flash EEPROM transistor devices to furnish reference currents to each of the sensing outputs of each word. The current through the flash storage cells is compared with these reference currents through the flash reference cells to determine whether a "zero" or a "one" condition exists in the flash storage cells. Since these reference currents are used to measure the state of the storage cells, these currents must be very precise in value. In one particular flash EEPROM memory array, in order to reduce the die area used by reference cells, current from a single reference cell is mirrored a number of times to provide identical reference currents for each of sixteen sensing cells used to generate a word wide output.

Figure 2:
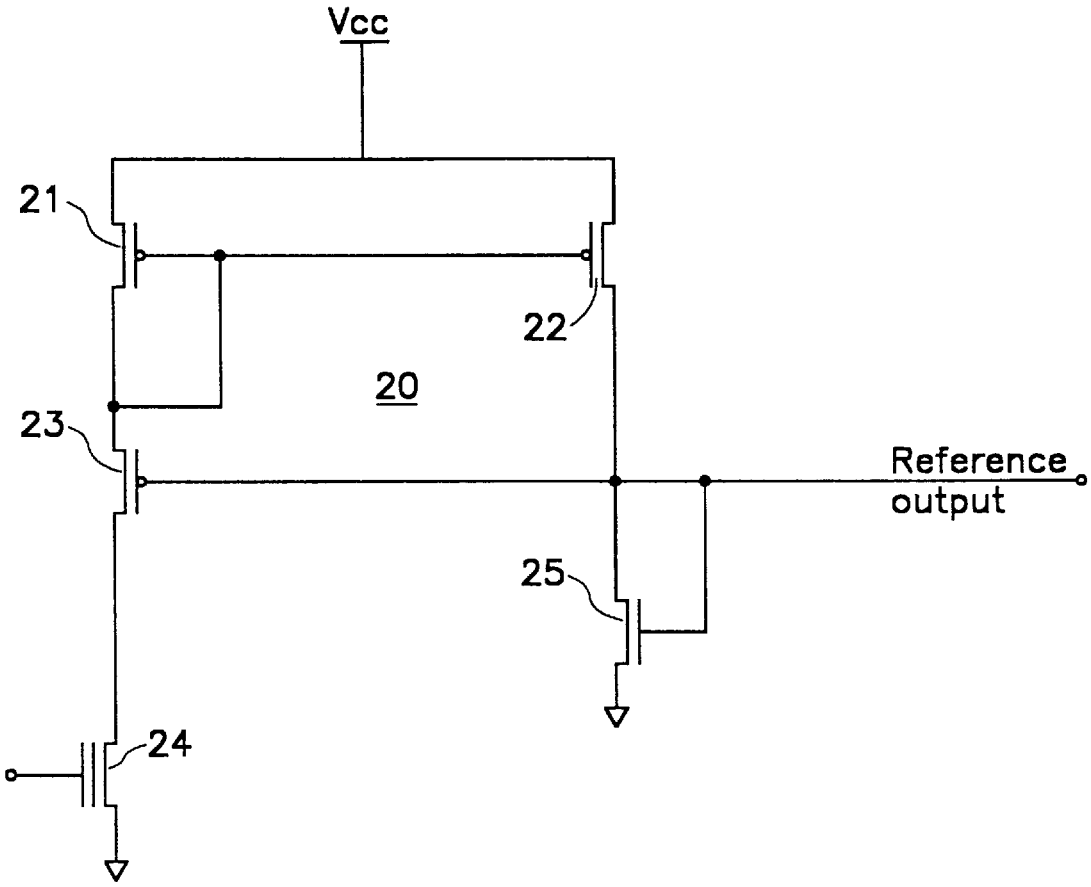
FIG. 2 is a block diagram of a self-compensating current mirroring circuit designed in accordance with the present invention.

FIG. 2 is a circuit diagram illustrating a basic configuration of a self-compensating current mirroring circuit 20 which may be used in circuitry furnishing reference currents for flash EEPROM memory arrays as well as in other circuits. The circuit 20 includes a pair of identically-sized P type field effect transistor devices 21 and 22 having their source and gate terminals joined so that the voltages applied to these terminals are identical. With this configuration and appropriate biasing values to cause the devices to be operated in saturation, current from a flash EEPROM reference device 24 will produce identical currents in the two devices 21 and 22 and a N type transistor device 25.

Variations in temperature, noise, or other ambient conditions in the circuit 20 may cause the current through the two devices 21 or 22 to vary with respect to the other. To maintain currents through the two devices constant in the face of such variations, a P type field effect transistor device 23 is connected with its source and drain terminals in the current path between the flash device 24 and the device 21 and with its gate terminal at the drain terminal of the device 22. This arrangement provides negative feedback which corrects for changes in ambient conditions. For example, if the voltage at the drain of the device 23 increases, the voltage at the drain of the device 21 will also increase. Increasing the voltage at the drain of the device 21 increases the voltage at the gate of the device 22, decreasing the voltage at the gate of the device 23 and reducing the level of the voltage at the drain of the device 21. Thus when the current through the device 21 varies, the change in voltage at the gate of the device 23 changes the current through the device 21 in the same manner. This feedback assures that accurate current mirroring occurs over the operational range of the devices.

However, it will be noted that using this feedback arrangement, the voltage at the drains of the two devices 21 and 22 are not equal but vary by the amount of the voltage drop between the source and gate terminals of the device 23. This means that the currents through the two devices are not, in fact, exactly equal because even in saturation the current through a device is a function of the drain voltage. Most designers simply ignore this difference. However, there are many situations such as those involved in accurately sensing the values of memory cells in which it may be desirable to provide more precise current mirroring.

The present invention provides equal currents through the mirroring transistors 21 and 22 by a unique approach. Rather than using identical devices 21 and 22, the dimensions of these devices are made sufficiently different to compensate for the difference in the voltages at the drain terminals of the two devices. This causes the currents through the devices 21 and 22 to be identical and restores the precise current mirroring of the non-compensated circuit.

The amounts by which the dimensions are varied depend on the particular operating parameters and device sizes of the current mirroring circuitry. However, in one circuit the device 21 was designed with a length of five microns and a width of 150 microns while the device 22 was designed with a length of five microns and a width of 140 microns. Operating in a range in which the voltage Vcc was five volts, the circuit 20 provides the identical currents desired.

One problem with compensated current mirroring circuits, however, is that outside of the range of operating parameters in which they are designed to operate, the compensation provided no longer functions correctly. For example, at some point, the source voltage Vcc is insufficient to provide a sufficient threshold voltage for the device 23; and the circuit will not function. Consequently, with circuits which may be operated in a plurality of ranges, such self-compensating circuits may not function correctly. The present invention overcomes this problem of the prior art and allows current to be correctly mirrored over a plurality of supply voltage ranges.

Figure 3:
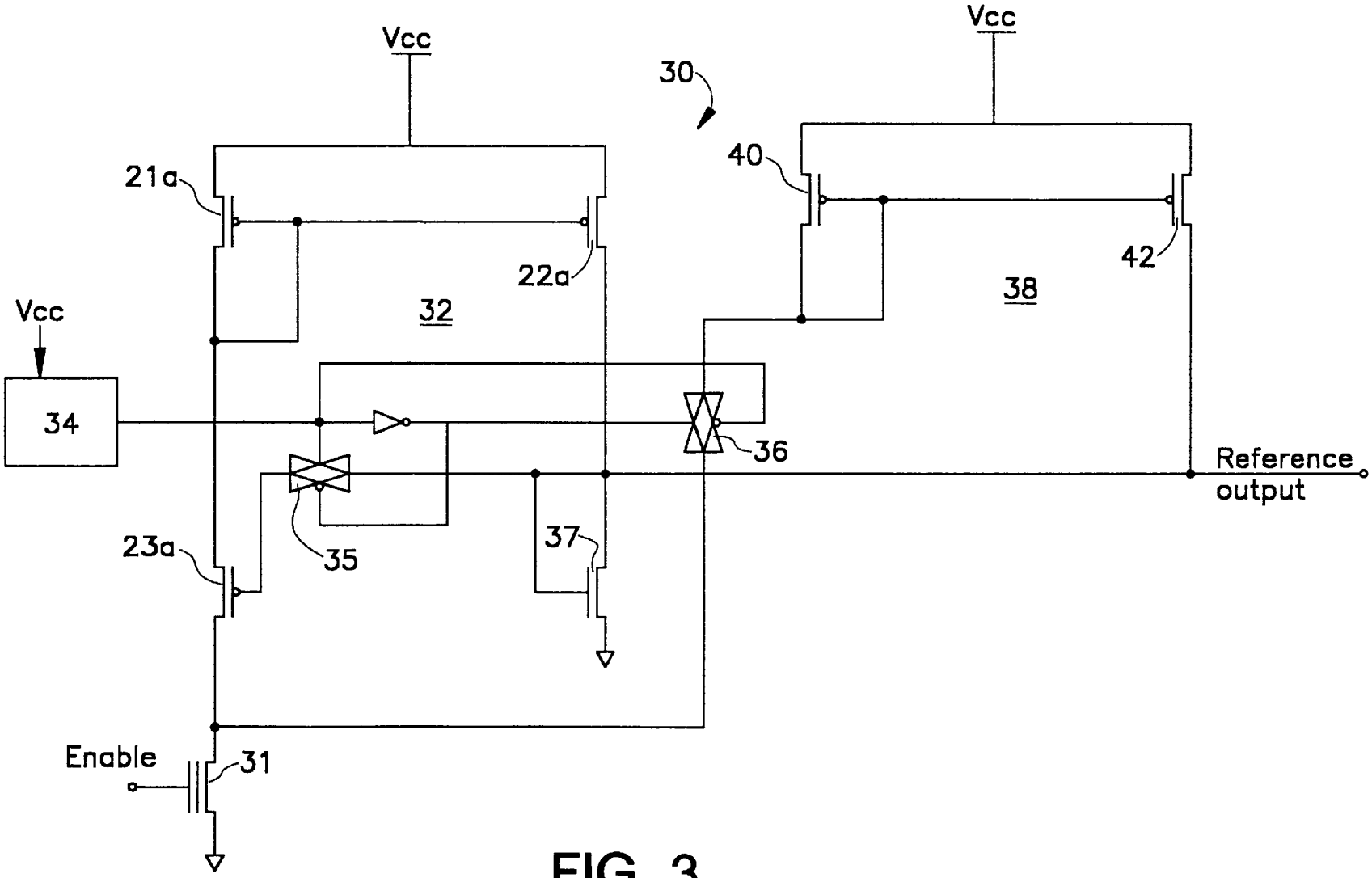
FIG. 3 is a block diagram of a current mirroring circuit designed in accordance with the present invention.

FIG. 3 is a block diagram of a circuit 30 designed in accordance with the present invention to allow current mirroring to take place with a plurality of different supply voltages Vcc. The circuit 30 mirrors a voltage provided across a flash EEPROM memory device 31 when an enabling signal is provided at the gate terminal of the device 31. When operating at supply voltage Vcc of five volts, a signal having a positive value is provided by a detector circuit 34 causing a pair of transmission gates 35 and 36 to switch current from the device 31 through a first current mirroring circuit 32 essentially identical to the circuit described in FIG. 2. The current through the device 31 thus is transferred between ground and the voltage Vcc through a compensating P type device 23*a* and a P type device 21*a*. Since the device 21*a* and a device 22*a* have their respective source and gate terminals joined, and because the dimensions of the devices 21*a* and 22*a* are chosen such that the gate-source voltage Vgs of the device 23*a* is just sufficient that identical currents flow through the devices 21*a* and 22*a* even though the drain voltages of the devices 21*a* and 22*a* differ. Moreover, the compensating device 23*a* will maintain these currents equal although ambient conditions of the circuit 30 change. The current through the device 22*a* flows to ground through a N type transistors device 37. The current through the device 37 provides a reference voltage level which may be used in a particular embodiment to provide an input to a sense amplifier of a flash EEPROM memory array.

In a second range of operation in which the voltage Vcc is 3.6 or less volts, a digital signal of a negative value is provided by the detector circuit 34 causing the transmission gates 35 and 36 to switch the current from the device 31 through a second current mirroring circuit 38. The circuit 38 includes a pair of identical P type transistor devices 40 and 42 connected in a standard non-compensated current mirroring arrangement. As will be seen, current through the flash device 31 is transferred through the device 40 and mirrored through the device 42 to provide the desired reference potential at the output.

Thus, the present invention allows precise control of current values with compensation for ambient conditions in a first operating range but continues to provide uncompensated mirrored currents suitable for operation in the second range of operation.

It would be possible to provide a compensated current mirroring circuit in place of the standard circuit used in the circuit 38 in order to attain additional precision in both ranges of operation shown. It would also be possible within the present invention to include additional current compensating circuits for additional operating ranges without departing from the present invention.

Although the present invention has been described in terms of a preferred embodiment, it will be appreciated that various modifications and alterations might be made by those skilled in the art without departing from the spirit and scope of the invention. The invention should therefore be measured in terms of the claims which follow.

What is claimed is:

1. A current mirroring circuit comprising:

an EEPROM cell having a source of current to be mirrored, a supply voltage, a first field effect transistor device arranged to provide a current path between the source of current and the supply voltage, a compensating field effect transistor device arranged to provide a current path between the source of current and the supply voltage, a second field effect transistor device arranged to provide a second current path between the supply voltage and a reference node, the first and second field effect transistor devices having gate terminals and source terminals connected together, the gate terminals of the first and second field effect transistor devices being directly connected to the source of the compensating field effect transistor device, the gate terminal of the compensating field effect transistor device being directly connected to the drain terminal of the second field effect transistor device, and the size of the first and second field effect transistor devices being such that the currents of each device in saturation are equal to the source of current to be mirrored that is contained in the EEPROM cell.

2. A current mirroring circuit comprising:

a source of current to be mirrored, a supply voltage, a first field effect transistor device arranged to provide a current path between the source of current and the supply voltage, a compensating field effect transistor device arranged to provide a current path between the source of current and the supply voltage, a second field effect transistor device arranged to provide a second current path between the supply voltage and a reference node, the first and second field effect transistor devices having gate terminals and source terminals connected together, the gate terminal of the compensating field effect transistor device being joined to the drain terminal of the second field effect transistor device, the size of the first and second field effect transistor devices being such that the currents of each device in saturation are equal, a second supply voltage, a third field effect transistor device arranged to provide a current path between the source of current and the second supply voltage, a fourth field effect transistor device arranged to provide a current path between the second supply voltage and the reference node, a detector circuit for determining the supply voltage in use, and a switching circuit for connecting the current path between the source of current and the supply voltage if the supply voltage is in use and for connecting the current path between the source of current and the second supply voltage if the second supply voltage is in use.

3. A current mirroring circuit as claimed in claim 2 in which the supply voltage has a value of five volts, and the second supply voltage has a value of not greater than 3.6 volts.

4. A current mirroring circuit as claimed in claim 1 in which the first field effect transistor device has a width of 150 microns and a length of 5 microns, and the second field effect transistor device has a width of 140 microns and a length of 5 microns.

5. A computer system comprising:

a central processing unit;

main memory;

a system bus; and secondary memory joined to the system bus including:

a current mirroring circuit comprising:

an EEPROM cell having a source of current to be mirrored, a supply voltage, a first field effect transistor device arranged to provide a current path between the source of current and the supply voltage, a compensating field effect transistor device arranged to provide a current path between the source of current and the supply voltage, a second field effect transistor device arranged to provide a second current path between the supply voltage and a reference node, the first and second field effect transistor devices having gate terminals and source terminals connected together, the gate terminals of the first and second field effect transistor devices being directly connected to the source of the compensating field effect transistor device, the gate terminal of the compensating field effect transistor device being directly connected to the drain terminal of the second field effect transistor device, and the size of the first and second field effect transistor devices being such that the currents of each in saturation are equal to the source of current to be mirrored that is contained in the EEPROM cell.

6. A computer system comprising:

a central processing unit;

main memory;

a system bus; and secondary memory joined to the system bus including:

a current mirroring circuit comprising:

a source of current to be mirrored, a supply voltage, a first field effect transistor device arranged to provide a current path between the source of current and the supply voltage, a compensating field effect transistor device arranged to provide a current path between the source of current and the supply voltage, a second field effect transistor device arranged to provide a second current path between the supply voltage and a reference node, the first and second field effect transistor devices having gate terminals and source terminals connected together, the gate terminal of the compensating field effect transistor device being joined to the drain terminal of the second field effect transistor device, and the size of the first and second field effect transistor devices being such that the currents of each in saturation are equal, a second supply voltage, a third field effect transistor device arranged to provide a current path between the source of current and the second supply voltage, a fourth field effect transistor device arranged to provide a current path between the second supply voltage and the reference node, a detector circuit for determining the supply voltage in use, and a switching circuit for connecting the current path between the source of current and the supply voltage if the supply voltage is in use and for connecting the current path between the source of current and the second supply voltage if the second supply voltage is in use.

7. A computer system as claimed in claim 6 in which the supply voltage has a value of five volts, and the second supply voltage has a value of not greater than 3.6 volts.

8. A computer system as claimed in claim 5 in which the first field effect transistor device has a width of 150 microns and a length of 5 microns, and the second field effect transistor device has a width of 140 microns and a length of 5 microns.

9. A current mirroring circuit comprising:

an EEPROM means for supplying a current to be mirrored, means for supplying a voltage, first field effect transistor means arranged to provide a current path between the means for supplying a current and the means for supplying a voltage, compensating field effect transistor means arranged to provide a current path between the means for supplying a current and the means for supplying a voltage, second field effect transistor means arranged to provide a current path between the means for supplying a voltage and a reference node, the first and second field effect transistor means having gate terminals and source terminals connected together, the gate terminals of the first and second field effect transistor means being directly connected to the source of the compensating field effect transistor means, the gate terminal of the compensating field effect transistor means being directly connected to the drain terminal of the second field effect transistor means, and the size of the first and second field effect transistor means being such that the drain voltages of each in saturation are equal.

10. A current mirroring circuit comprising:

means for supplying a current to be mirrored, means for supplying a voltage, first field effect transistor means arranged to provide a current path between the means for supplying a current and the means for supplying a voltage, compensating field effect transistor means arranged to provide a current path between the means for supplying a current and the means for supplying a voltage, second field effect transistor means arranged to provide a current path between the means for supplying a voltage and a reference node, the first and second field effect transistor means having gate terminals and source terminals connected together, the gate terminal of the compensating field effect transistor means being joined to the drain terminal of the second field effect transistor means, the size of the first and second field effect transistor means being such that the drain voltages of each in saturation are equal, means for supplying a second voltage, third field effect transistor means arranged to provide a current path between the means for supplying a current and the means for supplying a second voltage, fourth field effect transistor means arranged to provide a current path between the means for supplying a second voltage and the reference node, means for determining the voltage in use, and means for connecting the current path between the means for supplying a current and the means for supplying a voltage if the means for supplying a voltage is in use and for connecting the current path between the means for supplying a current and the means for supplying a second voltage if the means for supplying a second voltage is in use.

11. A current mirroring circuit as claimed in claim 9 in which the voltage supplied by the means for supplying a voltage has a value of five volts, and the voltage supplied by the means for supplying a second voltage has a value of not greater than 3.6 volts.

12. A computer system comprising:

a central processing means;

main memory means;

system busing means; and secondary memory means joined to the system busing means including:

current mirroring circuit comprising:

an EEPROM means for supplying a current to be mirrored, means for supplying a voltage, first field effect transistor means arranged to provide a current path between the means for supplying a current and the means for supplying a voltage, compensating field effect transistor means arranged to provide a current path between the means for supplying a current and the means for supplying a voltage, second field effect transistor means arranged to provide a current path between the means for supplying a voltage and a reference node, the first and second field effect transistor means having gate terminals and source terminals connected together, the gate terminals of the first and second field effect transistor means being directly connected to the source of the compensating field effect transistor means, the gate terminal of the compensating field effect transistor means being directly connected to the drain terminal of the second field effect transistor means, and the size of the first and second field effect transistor means being such that the currents of each in saturation are equal to the current to be mirror supplied by the EEPROM means.

13. A computer system comprising:

a central processing means;

main memory means;

system busing means; and secondary memory means joined to the system busing means including:

current mirroring circuit comprising:

means for supplying a current to be mirrored, means for supplying a voltage, first field effect transistor means arranged to provide a current path between the means for supplying a current and the means for supplying a voltage, compensating field effect transistor means arranged to provide a current path between the means for supplying a current and the means for supplying a voltage, second field effect transistor means arranged to provide a current path between the means for supplying a voltage and a reference node, the first and second field effect transistor means having gate terminals and source terminals connected together, the gate terminal of the compensating field effect transistor means being joined to the drain terminal of the second field effect transistor means, wherein the size of the first and second field effect transistor means being such that the currents of each in saturation are equal, means for supplying a second voltage, third field effect transistor means arranged to provide a current path between the means for supplying a current and the means for supplying a second voltage, fourth field effect transistor means arranged to provide a current path between the means for supplying a second voltage and the reference node, means for determining the voltage in use, and means for connecting the current path between the means for supplying a current and the means for supplying a voltage if the means for supplying a voltage is in use and for connecting the current path between the means for supplying a current and the means for supplying a second voltage if the means for supplying a second voltage is in use.

14. A computer system as claimed in claim 12 in which the voltage supplied by the means for supplying a voltage has a value of five volts, and the voltage supplied by the means for supplying a second voltage has a value not greater than 3.6 volts.

15. A current mirroring system comprising:

a source of current to be mirrored, a first supply voltage, a second supply voltage, a first self-compensating current mirroring circuit adapted to join the source of current, the first supply voltage, and a reference node to mirror the current from the source of current at the node;

a second current mirroring circuit adapted to join the source of current, the second supply voltage, and the reference node to mirror the current from the source of current at the node; and a switching circuit for connecting the first self-compensating current mirroring circuit between the source of current, the first supply voltage, and the reference node if the supply voltage is in use and for connecting the second current mirroring circuit between the source of current, the second supply voltage, and the reference node if the second supply voltage is in use.

16. A current mirroring system as claimed in claim 15 in which the second current mirroring circuit is a self-compensating current mirroring circuit.

17. A current mirroring system as claimed in claim 15 further comprising:

additional supply voltages;

additional current mirroring circuits each adapted to join the source of current, one of the additional supply voltages, and the reference node to mirror the current from the source of current at the node; and in which the switching circuit is adapted to connect one of the additional current mirroring circuits between the source of current, one of the additional supply voltages, and the reference node if the one of the additional supply voltages is in use.

18. A current mirroring system as claimed in claim 15 in which the switching circuit includes a circuit generating signals to indicate a voltage level detected, and transmission gates for connecting the source of current to the reference node through one of the mirroring circuits in response to signals generated to indicate a voltage level detected.

* * * * *